US006437519B1

(12) United States Patent
Ito

(10) Patent No.: US 6,437,519 B1
(45) Date of Patent: Aug. 20, 2002

(54) DISCHARGE LAMP LIGHTING CIRCUIT

(75) Inventor: Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 25 days.

(21) Appl. No.: 09/596,397

(22) Filed: Jun. 16, 2000

(30) Foreign Application Priority Data

Jun. 21, 1999 (JP) ..... 11-174375

(51) Int. Cl.[7] ..... H05B 37/02; H05B 41/00; H05B 37/00; G05F 1/00

(52) U.S. Cl. ..... 315/291; 315/307; 315/308; 315/291

(58) Field of Search ..... 315/308, 307, 315/291, 82, DIG. 5, DIG. 7, 225, 224, 276, 219, 151, 209 R, 119, 289, 278, 290, 315, 206

(56) References Cited

U.S. PATENT DOCUMENTS 5,019,959 A 5/1991 MacDonald et al.
5,212,428 A 5/1993 Sasaki et al.
5,486,740 A * 1/1996 Yamashita et al. ..... 315/308
5,629,588 A * 5/1997 Oda et al. ..... 315/308
5,705,898 A * 1/1998 Yamashita et al. ..... 315/308
5,914,566 A * 6/1999 Matsumoto ..... 315/82
5,973,457 A * 10/1999 Yamashita et al. ..... 315/225
6,002,215 A * 12/1999 Yamashita et al. ..... 315/308

FOREIGN PATENT DOCUMENTS

JP 4-141988 5/1992
JP 9-223591 8/1997

* cited by examiner

*Primary Examiner*—Don Wong
*Assistant Examiner*—Chuc Tran
(74) *Attorney, Agent, or Firm*—Fish & Richardson P.C.

(57) ABSTRACT

A lighting circuit 1 is provided with a DC power supply circuit 3, a DC-AC conversion circuit 4 for converting the output voltage of the DC power supply circuit 3 into AC voltage and then supplying the AC voltage to two discharge lamps, and a control circuit 8 for controlling lighting of each discharge lamp in response to a voltage or current detection signal related to the discharge lamp. A full-bridge type circuit consisting of four switch elements is formed in the DC-AC conversion circuit 4 to switch positive-polarity voltage and negative-polarity voltage output from the DC power supply circuit 3, and AC voltage generated by alternately operating the switch elements in pairs is supplied to each discharge lamp. To light one discharge lamp, the state of each of the switch elements is fixed so that the polarity of the voltage supplied to the discharge lamp before the discharge lamp is started is defined as either positive or negative polarity and the switch elements are alternately operated after the discharge lamp is lighted.

11 Claims, 9 Drawing Sheets

DISCHARGE LAMP LIGHTING CIRCUIT

BACKGROUND OF THE INVENTION

This invention relates to a discharge lamp lighting circuit which reduces the number of parts and costs by improving the configuration of a DC power supply circuit and a DC-AC conversion circuit making up the parts of the discharge lamp lighting circuit.

The configuration of a lighting circuit of a discharge lamp, such as a metal halide lamp, comprising a DC power supply circuit, a DC-AC conversion circuit, and a starter circuit is known. For example, in the configuration wherein a DC-DC converter is used as a DC power supply circuit and a full-bridge type circuit comprising two pairs of semiconductor switch elements for performing switching control and a driver circuit thereof are used for a DC-AC conversion circuit, the positive-polarity voltage (positive voltage) output by the DC-DC converter is converted into rectangular-wave voltage in the full-bridge type circuit, then this voltage is supplied to a discharge lamp.

To light a discharge lamp more reliably, the voltage applied to the discharge lamp needs to be set to a reasonably high voltage (overcurrent voltage) temporarily before the discharge lamp lights up. The reason is as follows: When a start pulse generated by a starter circuit is applied to the discharge lamp and the discharge lamp breaks down, the tube voltage of the discharge lamp lowers, so that charges of a smoothing capacitor in a DC power supply circuit or charges of a capacitor in a current auxiliary circuit (for example, refer to JP-A-9-223591) provided at a later stage of the DC power supply circuit become an electric current to the discharge lamp and transition to ark discharge can be accomplished reliably.

By the way, to light a plurality of discharge lamps by a lighting circuit in the related art, a DC power supply circuit and a DC-AC conversion circuit of full-bridge type configuration become necessary for each discharge lamp and the above-mentioned current auxiliary circuit becomes necessary at a later stage of each DC power supply circuit, thus the circuit configuration is complicated; this is a problem.

For example, to use a discharge lamp as a light source of a car's front light, if a front light is attached to each of the left and the right of the front of the vehicle, two left and right discharge lamps and their respective lighting circuits become necessary. To adopt a configuration wherein high and low beams are provided by separate discharge lamps (so-called four-light illumination), two left and two right discharge lamps and their respective lighting circuits are required.

SUMMARY OF THE INVENTION

It is therefore an object of the invention to simplify the circuit configuration of a lighting circuit of a plurality of discharge lamps and reduce the costs of the lighting circuit.

To the end, according to the invention, there is provided a discharge lamp lighting circuit comprising a DC power supply circuit for receiving DC input voltage and outputting any desired DC voltage, a DC-AC conversion circuit for converting the output voltage of the DC power supply circuit into AC voltage and then supplying the AC voltage to a plurality of discharge lamps, a detection circuit for detecting voltage or current related to each discharge lamp, and a control circuit for controlling voltage, current, or supply power of each discharge lamp in response to a detection signal from the detection circuit. In the discharge lamp lighting circuit, (a) positive-polarity voltage and negative-polarity voltage output separately from two output terminals of the DC power supply circuit are sent to the DC-AC conversion circuit;

(b) two pairs of switch elements provided in the DC-AC conversion circuit to switch the output voltages of the DC power supply circuit form a full-bridge type circuit configuration and AC voltage generated by alternately operating the switch elements in pairs by drive circuits of the switch elements is supplied to each discharge lamp; and (c) to light one of the discharge lamps, the state of each of the switch elements is fixed so that the polarity of the voltage supplied from the DC-AC conversion circuit to the discharge lamp before the discharge lamp is started is defined as either positive or negative polarity and the switch elements are alternately operated after the discharge lamp is lighted.

Therefore, according to the invention, for a plurality of discharge lamps, the two pairs of switch elements are provided in the DC-AC conversion circuit to form a full-bridge type circuit configuration and drive control is performed so as to alternately operate the switch elements. Thus, the circuit configuration is simplified and moreover, the polarity of the voltage supplied to the discharge lamp before the discharge lamp is lighted is fixed to either polarity, whereby the discharge lamp can be well lighted.

DETAILED DESCRIPTION OF THE PREFERRED EMBODIMENTS

Figure 1:
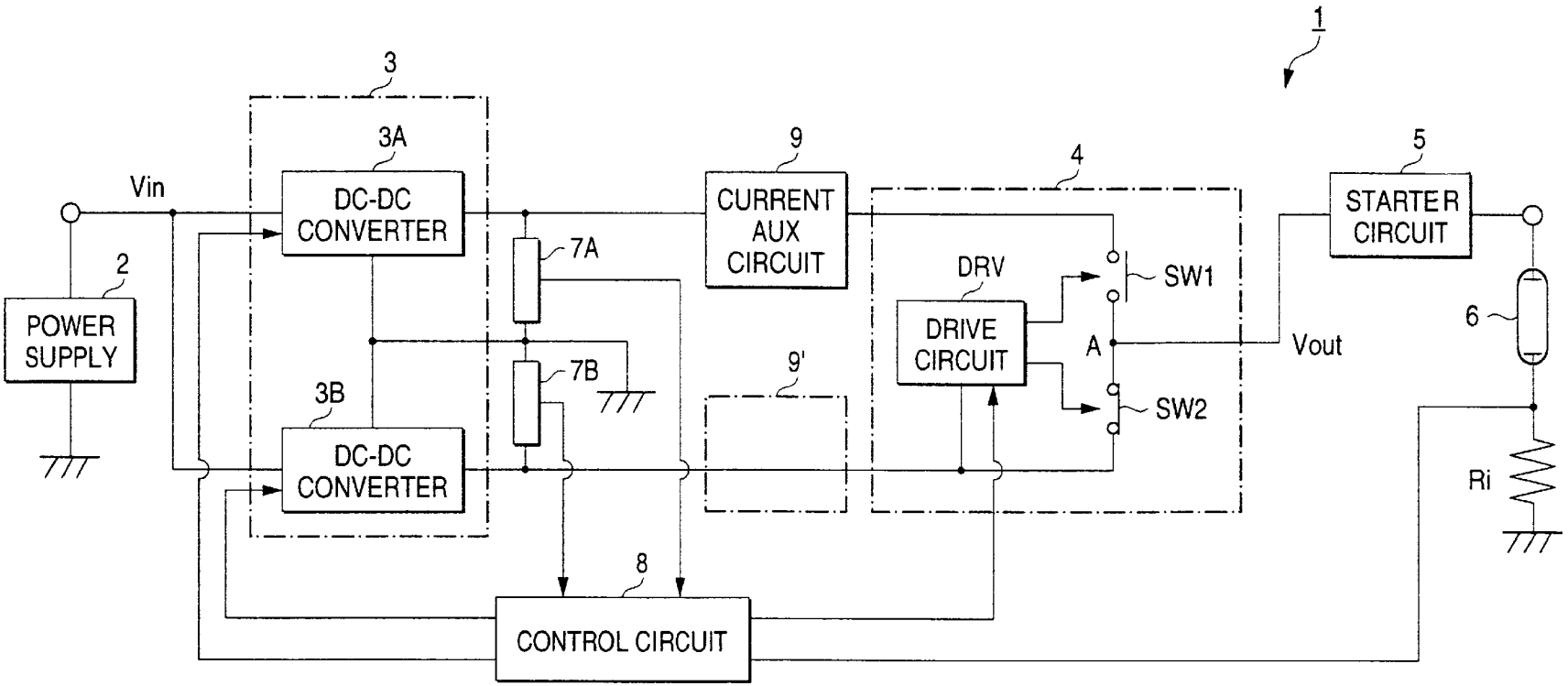
FIG. 1 is a circuit block diagram to show the basic configuration of a discharge lamp lighting circuit according to the invention.

FIG. 1 shows the basic configuration of a discharge lamp lighting circuit according to the invention; it shows the circuit configuration concerning one discharge lamp.

A discharge lamp lighting circuit 1 comprises a power supply 1, a DC power supply circuit 3, a DC-AC conversion circuit 4, and a starter circuit 5.

The DC power supply circuit 3 receives DC input voltage (Vin) from the power supply 2 and outputs any desired DC voltage. The output voltage is variable-controlled in response to a control signal from a control circuit 8 described later. The DC power supply circuit 3 uses DC-DC converters each having the configuration of a switching regulator (chopper type, flyback type, etc.,); a first circuit part (DC-DC converter 3A) for providing positive-polarity voltage output (positive voltage output) and a second circuit part (DC-DC converter 3B) for providing negative-polarity voltage output (negative voltage output) are placed in parallel with each other.

Figure 2:
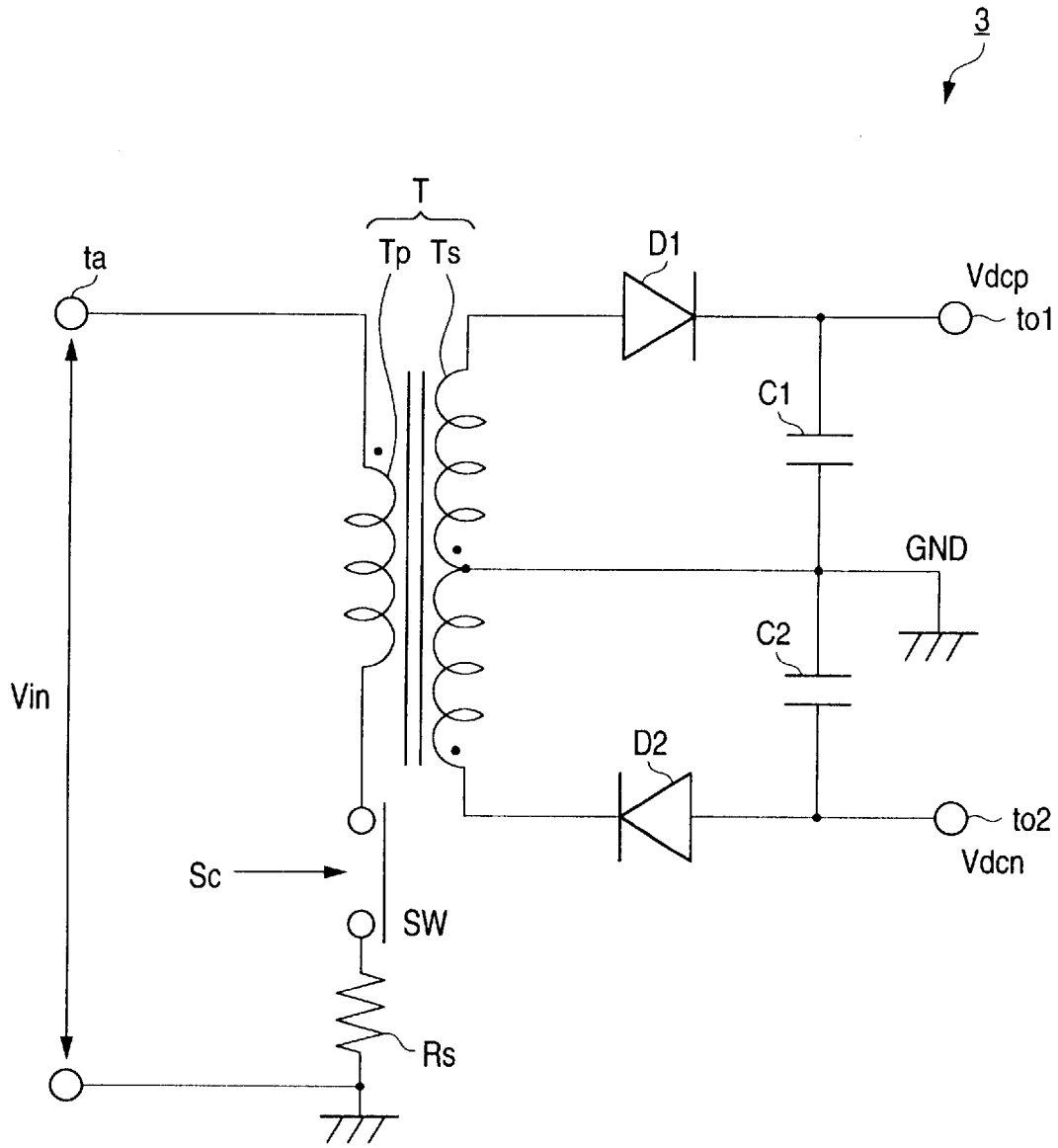
FIG. 2 is a circuit diagram to show a configuration example of a DC power supply circuit.

FIG. 2 shows a configuration example of the DC power supply circuit 3.

A primary winding Tp of a transformer T is connected at one end to a DC input terminal ta, whereby the voltage Vin is input. The primary winding Tp is grounded at an opposite end via a semiconductor switch element SW (simply indicated by a switch symbol in the figure; a field-effect transistor, etc., is used) and a current detection resistor Rs, which is arbitrary and need not necessarily be provided. A signal Sc from the control circuit (not shown) is supplied to a control circuit of the semiconductor switch element SW (a gate if the switch element SW is an FET) for performing switching control of the semiconductor switch element SW.

A secondary winding Ts of the transformer T is connected at one end to an anode of a diode D1 and a cathode of the diode D1 is grounded via a capacitor C1. Terminal voltage of the capacitor C1 becomes output voltage (Vdcp) via a terminal to1. The secondary winding Ts is connected at an opposite end to a cathode of a diode D2 and an anode of the diode D2 is grounded via a capacitor C2 and is connected to a terminal to2. Output voltage (Vdcn) is provided through the terminal to2.

Thus, the DC power supply circuit 3 outputs the positive-polarity voltage Vdcp (>0) and the negative-polarity voltage Vdcn (<0) separately from the two output terminals to1 and to2.

The "·" mark added to each winding of the transformer T denotes the winding start; for example, the "·" mark is added to each of the connection end to the diode D2 and the winding start end at an intermediate tap grounded.

The DC-AC conversion circuit 4 is placed at the stage following the DC power supply circuit 3 (see FIG. 1) for converting the output voltage of the DC power supply circuit 3 into AC voltage and then supplying the AC voltage to a discharge lamp 6. The positive-polarity voltage and the negative-polarity voltage are sent separately from the two output terminals of the DC power supply circuit 3 to the DC-AC conversion circuit 4. To switch the output voltage Vdcp of the DC-DC converter 3A and the output voltage Vdcn of the DC-DC converter 3B, a pair of semiconductor switch elements sw1 and sw2 (simply indicated by switch symbols in the figure although field-effect transistors, etc., are used as the switch elements) provided in the DC-AC conversion circuit 4 is operated alternately by a drive circuit DRV, and the generated AC voltage is supplied to the discharge lamp 6.

That is, one of the two switch elements sw1 and sw2 connected in series at the output stage of the DC power supply circuit 3, sw1, is connected to the output terminal of the DC-DC converter 3A and also to the output terminal of the DC-DC converter 3B via sw2. For example, an IC (integrated circuit) known as a half-bridge driver is used as the drive circuit DRV for performing switching control of the switch elements reciprocally. That is, the half bridge alternating operation is performed so that when the element sw1 is on, the element sw2 is turned of f and that when the element sw1 is off, the element sw2 is turned on based on signals supplied to the control terminals of the switch elements from the drive circuit DRV, whereby the DC voltage is converted into AC voltage.

As shown in FIG. 1, the drive circuit DRV is operated based on the negative-polarity voltage of the voltage Vdcn. Therefore, power supply voltage for the drive circuit DRV becomes necessary. Similar consideration is also required for a control signal (clock signal) input to the drive circuit DRV.

The starter circuit 5 is provided for generating a start signal (start pulse) at the beginning of lighting the discharge lamp 6 for starting the discharge lamp 6. The start signal is superposed on AC voltage Vout output by the DC-AC conversion circuit 4 and is applied to the discharge lamp 6. That is, the starter circuit 5 contains an inductive load (inductance component) and the discharge lamp 6 is connected at one electrode terminal to a connection point A of the switch elements sw1 and sw2 via the inductive load and at the other electrode terminal to ground (GND) directly or via current detection means (current detection resistor, coil, etc.,), whereby it is grounded.

For example, a configuration for directly detecting an electric current flowing into the discharge lamp by the above-mentioned current detection means (in FIG. 1, current detection resistor Ri) or a configuration for acquiring a current detection signal or a voltage detection signal at the stage following the DC power supply circuit 3 can be named as a detection circuit for detecting voltage or current related to the discharge lamp 6. As an example of the latter, as shown in FIG. 1, voltage detection means 7A and 7B (for example, each a circuit for detecting output voltage with a partial pressure resister, etc.,) are placed immediately following the DC-DC converters 3A and 3B respectively and a detection signal of output voltage detected by the means can be used as an alternative signal to a voltage detection signal related to the discharge lamp 6.

The control circuit 8 is provided for controlling voltage, current, or supply power of the discharge lamp 6 in response to the detection signal from the above-mentioned detection circuit. It sends a control signal to the DC power supply circuit 3, thereby controlling the output voltage or sends a control signal to the drive circuit DRV for controlling polarity switching of the bridge. The control circuit 8 also performs output control to reliably light the discharge lamp 6 by raising the supply voltage to the discharge lamp 6 to one level before the discharge lamp 6 is lighted.

A current auxiliary circuit 9 placed between the DC power supply circuit 3 and the DC-AC conversion circuit 4 is provided for aiding in reliably making the transition from glow discharge to arc discharge by supplying energy accumulated in a capacitive load provided in the current auxiliary circuit 9 to the discharge lamp 6 when the discharge lamp 6 is started. In FIG. 1, the current auxiliary circuit 9 is placed at the stage following the DC-DC converter 3A, because the polarity of the voltage supplied to the discharge lamp 6 before the discharge lamp 6 is started is defined to be positive. That is, if the polarity of the supply voltage is defined to be negative, a current auxiliary circuit 9' may be placed at the stage following the DC-DC converter 3B as indicated by the alternate long and short dash line in FIG. 1.

Figure 3A:
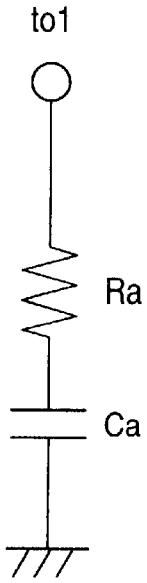
FIG. 3 is a circuit diagram to show a configuration example of a current auxiliary circuit.
Figure 3B:
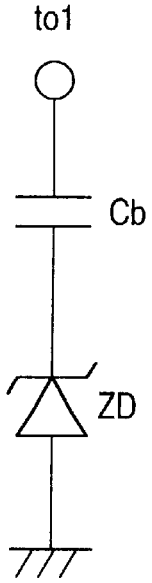
Figure 3C:
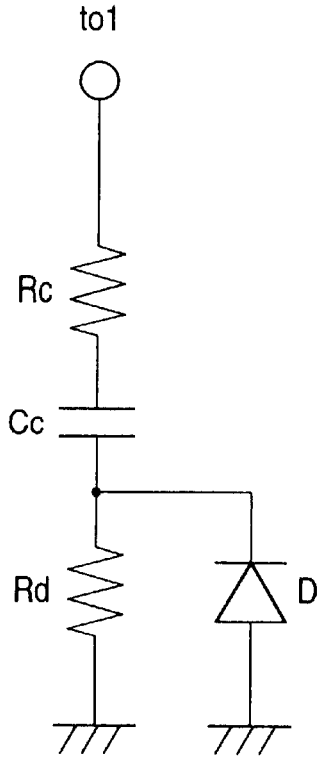

FIGS. 3A to 3C show configuration examples of the current auxiliary circuit 9, wherein each capacitor corresponds to the above-mentioned capacitive load.

In the configuration shown in FIG. 3A, the current auxiliary circuit 9 is a series circuit of a resister Ra and a capacitor Ca, and the resister Ra is connected at one end to the output terminal to1 of the DC-DC converter 3A and is grounded at an opposite end via the capacitor Ca.

In the configuration shown in FIG. 3B, the current auxiliary circuit 9 is a series circuit of a capacitor Cb and a Zener diode ZD, and the capacitor Cb is connected at one end to the output terminal to1 of the DC-DC converter 3A and is connected at an opposite end to a cathode of the Zener diode ZD and an anode of the Zener diode ZD is grounded.

In the configuration shown in FIG. 3C, a resister Rc is connected at one end to the output terminal to1 of the DC-DC converter 3A and is grounded at an opposite end via a series circuit of a capacitor Cc and a resistor Rd and a diode D is connected in parallel to the resistor Rd; a cathode of the diode D is connected between the capacitor Cc and the resister Rd and an anode of the diode D is grounded.

According to the lighting circuit 1, the half-bridge type configuration using a pair of switch elements and their drive circuit is only required for one discharge lamp, and the current auxiliary circuit may be provided only at the stage following either of the DC-DC converters 3A and 3B.

Next, the circuit configuration of the lighting circuit to circuitry for lighting a plurality of discharge lamps (for the control circuit, only its main part is shown) will be discussed with reference to FIG. 4. In the description to follow, two discharge lamps 61 and 62 are taken as an example; more generally, 61 may represent a first discharge lamp group and 62 may represent a second discharge lamp group.

In the lighting circuit 1 shown in FIG. 1, a pair of switch elements sw1 and sw2 and one drive circuit DRV are required for one discharge lamp; in a lighting circuit 1A for the two discharge lamps 61 and 62, double components, namely, two pairs of switch elements and two drive circuits are required.

In this case, the two DC-DC converters 3A and 3B making up the DC power supply circuit 3 are shared between the two discharge lamps and the DC-AC conversion circuit 4 placed at the stage following the DC-DC converters 3A and 3B has a full-bridge type circuit configuration comprising four switch elements sw1, sw2, sw3, and sw4 (simply indicated by switch symbols in the figure).

That is, one of the switch elements sw1 and sw2 connected in series as a first pair, sw1, is connected at one end to the output terminal of the current auxiliary circuit 9 placed at the stage following the DC-DC converter 3A and is connected at an opposite end to the output terminal to2 of the DC-DC converter 3B via the switch element sw2. The first discharge lamp 61 is connected to a connection point a of the switch elements sw1 and sw2 via (an inductive load of) a starter circuit 51.

One of the switch elements sw3 and sw4 connected in series as a second pair, sw3, is connected at one end to the output terminal of the current auxiliary circuit 9 and is connected at an opposite end to the output terminal to2 of the DC-DC converter 3B via the switch element sw4. The second discharge lamp 62 is connected to a connection point β of the switch elements sw3 and sw4 via (an inductive load of) a starter circuit 52.

At the stage following the DC-AC conversion circuit 4, the terminals of the first and second discharge lamps 61 and 62 not connected to the connection point α or β P are connected to ground directly or via current detection means (in the figure, current detection resistors Ri1 and Ri2).

A half-bridge driver IC is used as each of drive circuits DRV1 and DRV2. The one drive circuit DRV1 controls turning on/off the switch elements sw1 and sw2 and the other drive circuit DRV2 controls turning on/off the switch elements sw3 and sw4. That is, assuming that the state of each switch element is defined so that the switch element sw1 is turned on and the switch element sw2 is turned off by the drive circuit DRV1 at one time, the state of each switch element is defined so that the switch element sw3 is turned off and the switch element sw4 is turned on by the drive circuit DRV2 at this time. Assuming that the state of each switch element is defined so that the switch element sw1 is turned off and the switch element sw2 is turned on by the drive circuit DRV1 at another time, the state of each switch element is defined so that the switch element sw3 is turned on and the switch element sw4 is turned off by the drive circuit DRV2 at this time. Thus, the switch elements sw1 and sw4 become the same state and the switch elements sw2 and sw3 become the same state; they alternately operate reciprocally.

Therefore, the two pairs of the switch elements are turned on and off, whereby while positive-polarity voltage is supplied to the first discharge lamp 61, for example, negative-polarity voltage is supplied to the second discharge lamp 62; conversely, while negative-polarity voltage is supplied to the first discharge lamp 61, positive-polarity voltage is supplied to the second discharge lamp 62.

A current detection and light determination circuit 10 is a circuit for receiving a current detection signal of each discharge lamp undergoing voltage conversion through the current detection resistor Ri1, Ri2 and detecting a current value and determining whether or not each discharge lamp is lighted; it consists of a current detection circuit 10*a* and a light determination circuit 10*b*.

To detect a current, the following item should be noted:

Assuming that a shunt resistor (Ri1 or Ri2) is inserted between one electrode terminal of each discharge lamp and ground as current detection means for detecting a current flowing into the discharge lamp, the current of the discharge lamp can be detected by detecting a voltage drop occurring in the resistor. However, the direction of the detection signal at the time (in FIG. 4, the detection signal related to the discharge lamp 61 is Si1 and that related to the discharge lamp 62 is Si2) becomes a problem. That is, since the direction of the current flowing into the discharge lamp alternates in response to the polarity of square wave, the detection signal becomes a positive value or a negative value; for example, assuming that the detection signal value of a current flowing when the positive-polarity voltage of square wave is supplied to the discharge lamp is a positive value, the detection signal value of a current flowing when the negative-polarity voltage of square wave is supplied to the discharge lamp because of polarity inversion is a negative value.

Such polarity (or sign) change of the detection signal in time (inversion) is cumbersome to handle for the control circuit using the detection signal and thus is not preferred. Then, to fix the polarity of the detection signal, for example, an absolute value circuit or a circuit configuration wherein a non-inverting amplification circuit and an inverting amplification circuit are placed in parallel for a voltage drop caused by the current detection resistor Ri1 (or Ri2) and the output voltage of the non-inverting amplification circuit or the inverting amplification circuit is selectively output as shown in FIG. 5 can be adopted.

Figure 5:
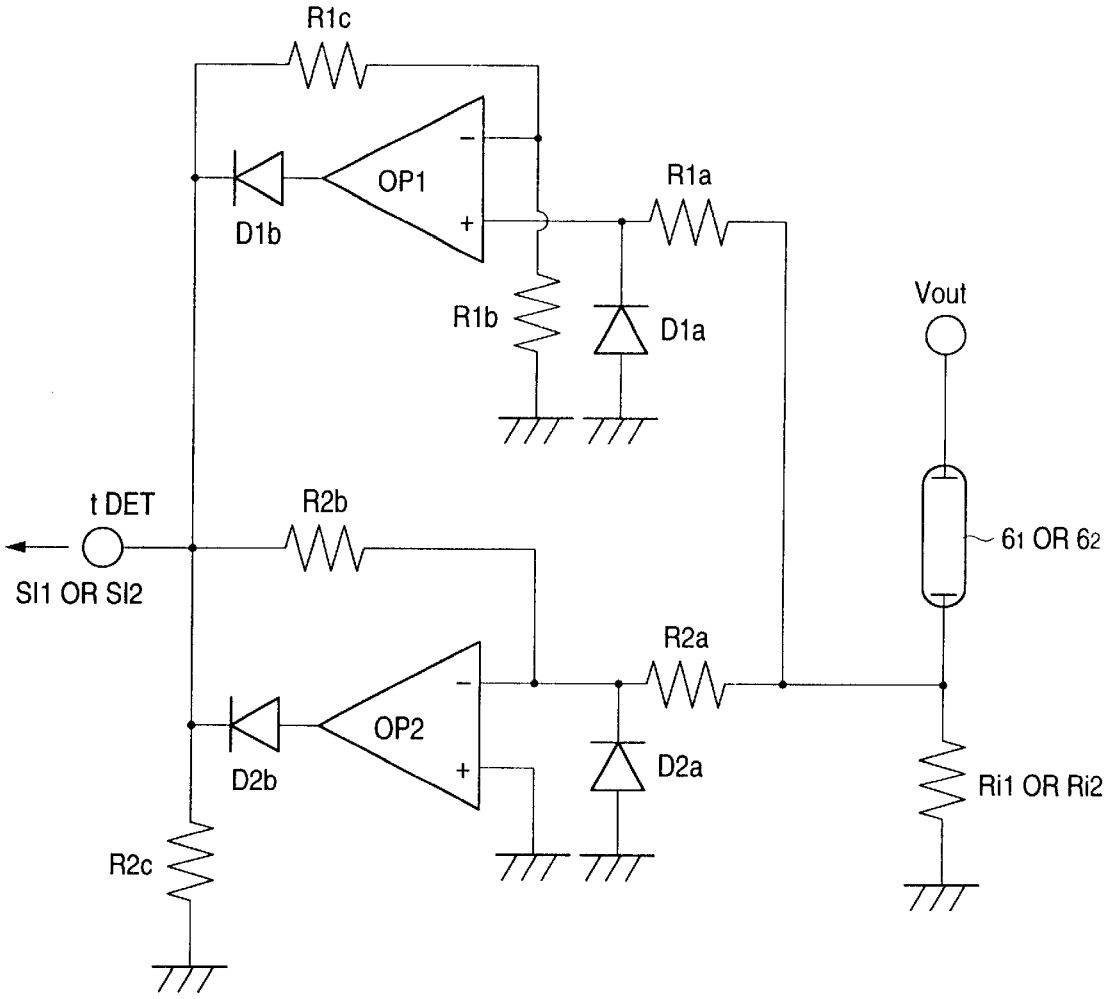
FIG. 5 is a drawing to show a circuit configuration example for fixing the polarity of a current detection signal related to a discharge lamp.

In FIG. 5, an operational amplifier OP1 provides a non-inverting amplification circuit and a non-inverting input terminal of the operational amplifier OP1 is connected between the discharge lamp 61 (or 62) and the current detection resistor Ri1 (or Ri2) via a resistor R1*a*. A diode D1*a* has a cathode connected to the non-inverting input terminal of the operational amplifier OP1 and an anode grounded. The diode D1*a* and a diode D2*a* (described later) are added for the purpose of protecting the operational amplifier when the input voltage to the operational amplifier is inverted to a negative value.

An output terminal of the operational amplifier OP1 is connected to an anode of a diode D1*b* and a cathode of the diode D1*b* is connected to a current detection terminal tDET. The non-inverting input terminal of the operational amplifier OP1 is grounded via a resistor R1*b* and is connected to the cathode of the diode D1*b* via a resistor R1*c*. The resistance values of the resistors R1*a*, R1*b*, and R1*c* are set to the same value.

An operational amplifier OP2 provides an inverting amplification circuit and an inverting input terminal of the operational amplifier OP2 is connected between the discharge lamp 61 (or 62) and the current detection resistor Ri1 (or Ri2) via a resistor R2*a*. A diode D2*a* has a cathode connected to the inverting input terminal of the operational amplifier OP2 and an anode grounded.

An output terminal of the operational amplifier OP2 is connected to an anode of a diode D2*b* and a cathode of the diode D2*b* is connected to the current detection terminal tDET and is grounded via a resistor R2*c*. The inverting input terminal of the operational amplifier OP2 is connected to the cathode of the diode D2*b* via a resistor R2*b* (the resistance value of the resistor R2*b* is set to twice that of the resistor R2*a*). A non-inverting input terminal of the operational amplifier OP2 is grounded.

In the circuit, the voltage drop caused by the current detection resistor Ri1 (or Ri2) is amplified to twice voltage by the non-inverting amplification circuit of the operational amplifier OP1; on the other hand, it is amplified to "−2" X voltage by the inverting amplification circuit of the operational amplifier OP2. The voltage, whichever is higher, is selected by the diodes D1*b* and D2*b* placed at the output terminals of the operational amplifiers, and is output to the current detection terminal tDET. That is, when positive-polarity voltage (or positive voltage in square wave) is supplied to the discharge lamp 6, the output voltage of the non-inverting amplification circuit of the operational amplifier OP1 is provided at the current detection terminal tDET and when negative-polarity voltage (or negative voltage in square wave) is supplied to the discharge lamp 6, the output voltage of the inverting amplification circuit of the operational amplifier OP2 is provided at the current detection terminal tDET. The detection voltage thus provided can be used as a signal to determine whether or not the discharge lamp is lighted, a signal to determine the light state of the discharge lamp and stipulate supply power.

The light determination circuit 10*b* receives signals from the current detection circuit provided for each discharge lamp (the signal related to the discharge lamp 61 is expressed as SI1 and the signal related to the discharge lamp 62 is expressed as SI2) and compares the signal levels with predetermined reference voltages, then provides a determination signal indicating the light or out state of each discharge lamp as a binary (binarized) signal.

Figure 6:
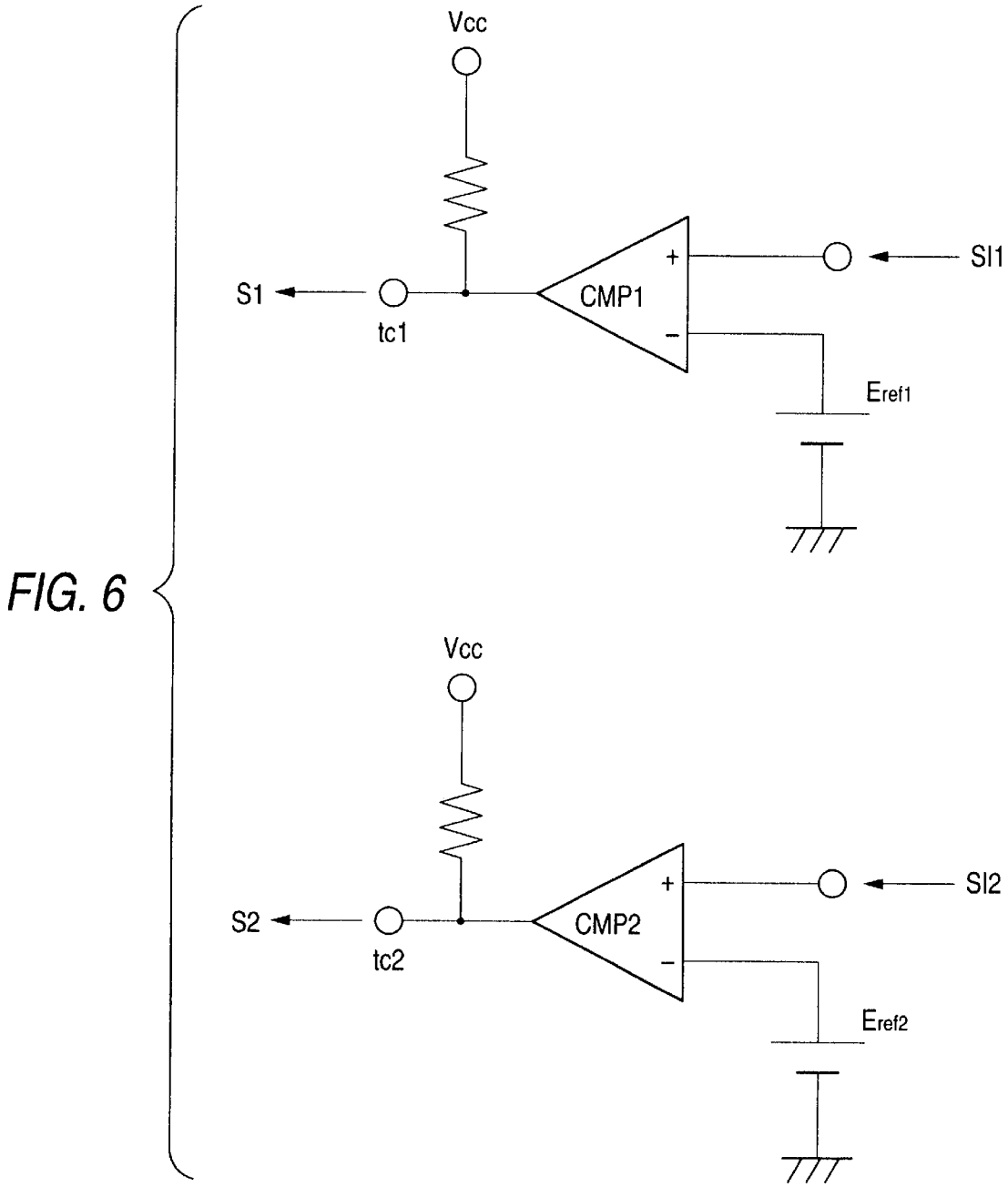
FIG. 6 is a drawing to show a configuration example of a discharge lamp light determination circuit.

FIG. 6 shows such a circuit example. The signal SI1 from the current detection circuit 10*a* is supplied to a plus input terminal of a comparator CMP1 and the reference voltage indicated by constant-voltage source Eref1 is supplied to a minus input terminal of the comparator CMP1. Therefore, when the voltage level of the signal SI1 is higher than the reference voltage, the comparator CMP1 outputs a signal high from an output terminal tcl. The signal SI2 from the current detection circuit 10*a* is supplied to a plus input terminal of a comparator CMP2 and the reference voltage indicated by constant-voltage source Eref2 is supplied to a minus input terminal of the comparator CMP2. Therefore, when the voltage level of the signal SI2 is higher than the reference voltage, the comparator CMP2 outputs a signal high from an output terminal tc2. In the figure, the signal provided from the output terminal tc1 is expressed as S1 (when the S1 signal is high, it indicates that the discharge lamp 61 is lighted and when the S1 signal is low, it indicates that the discharge lamp 61 is out) and the signal provided from the output terminal tc2 is expressed as S2 (when the S2 signal is high, it indicates that the discharge lamp 62 is lighted and when the S2 signal is low, it indicates that the discharge lamp 62 is out). The resister inserted between the output terminal of each comparator and power supply voltage Vcc is a pull-up resistor.

Figure 7:
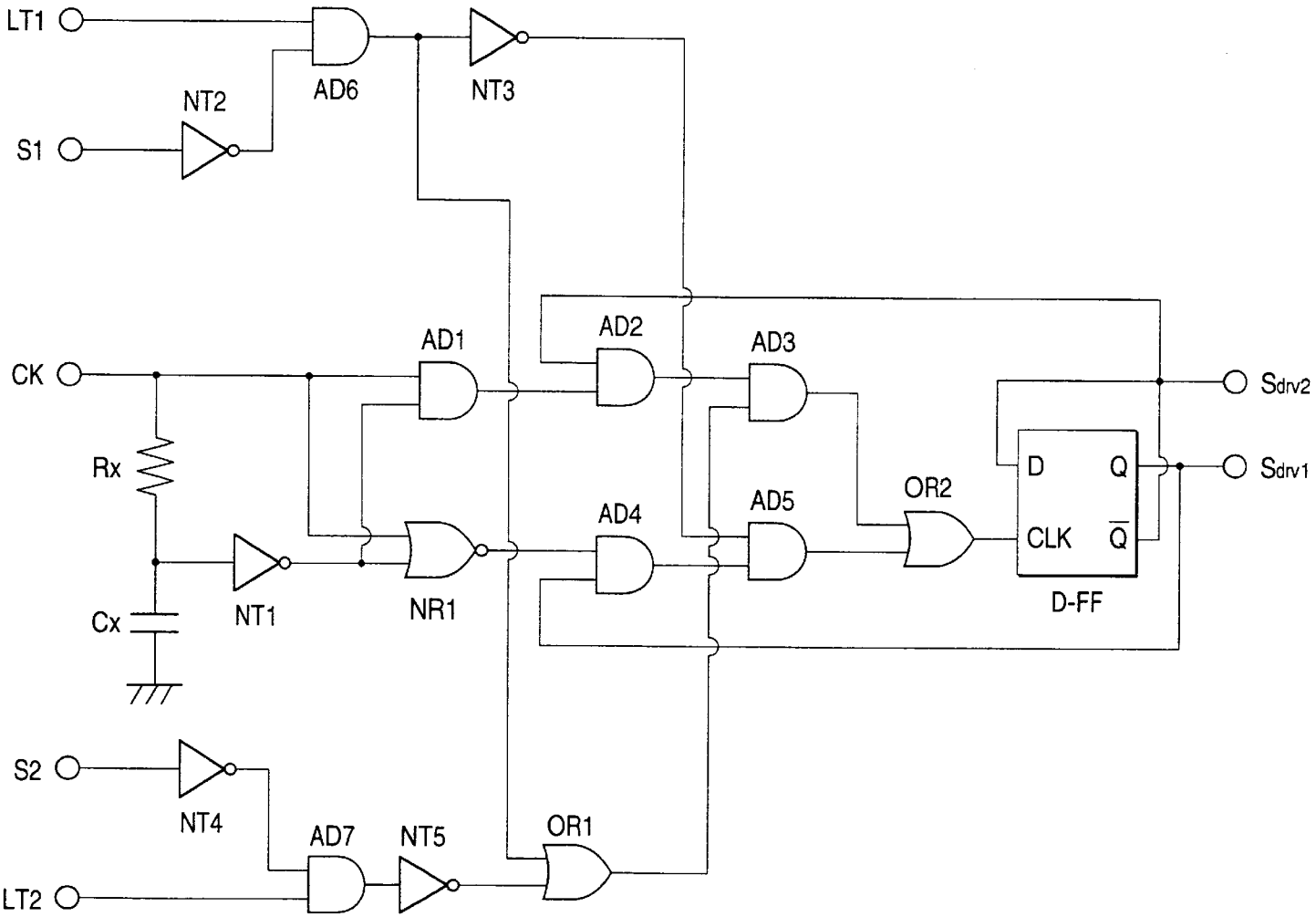
FIG. 7 is a circuit diagram to show a configuration example of a circuit for generating control signals sent to drive circuits in a DC-AC conversion circuit.

A polarity switch control circuit 11 (see FIG. 4) is provided for receiving light instruction signals corresponding the discharge lamps 61 and 62 (the signals are generated by operating an operation switch in a manual lighting mode or by an automatic light control circuit in an automatic lighting mode and the light instruction signals corresponding the discharge lamps 61 and 62 are expressed LT1 and LT2 respectively) and the light determination signals S1 and S2 from the light determination circuit 10*b* and generating control signals sent to the drive circuits DRV1 and DRV2 in the DC-AC conversion circuit 4. FIG. 7 shows an example of the polarity switch control circuit 11 (a configuration example using logical gates).

A signal CK in the figure is a signal sent from a clock signal generation circuit (not shown) and is a square wave signal of a basic frequency corresponding to a discharge lamp lighting frequency (for example, about 250 to 500 Hz). The signal CK is sent through a series circuit of a resistor Rx and a capacitor Cx to a two-input AND (conjunction) gate AD1 and a two-input NOR (non-disjunction) gate NR1. That is, the time constant circuit consisting of the resistor Rx and the capacitor Cx is provided for generating a short-duration pulse on the rising edge or the falling edge of the signal CK (the time constant determined by the resistance value of the resistor Rx and the capacitance of the capacitor Cx is set to an extremely small value), and terminal voltage of the capacitor Cx is sent through a NOT (logical negation) gate NT1 to one terminal of the gate AD1 and one terminal of the gate NR1 (the signal CK is input to the other input terminals of the gates).

An output signal of the gate AD1 is input to one input terminal of a two-input AND gate AD2 at the following stage and a Q bar output signal (inversion signal of Q output signal) of a D flip-flop D-FF described later is input to the other input terminal of the gate AD2. An output signal of the gate AD2 is input to one input terminal of a two-input AND gate AD3 at the following stage.

An output signal of the gate NR1 is input to one input terminal of a two-input AND gate AD4 at the following stage and a Q output signal of the D flip-flop D-FF described later is input to the other input terminal of the gate AD4. An output signal of the gate AD4 is input to one input terminal of a two-input AND gate AD5 at the following stage.

The above-mentioned light instruction signal LT1 is supplied to one input terminal of a two-input AND gate AD6 and the above-mentioned light determination signal S1 is input through a NOT gate NT2 to the other input terminal of the gate AD6. An output signal of the gate AD6 is input through a NOT gate NT3 to the other input terminal of the gate AD5.

The above-mentioned light instruction signal LT2 is supplied to one input terminal of a two-input AND gate AD7 and the above-mentioned light determination signal S2 is input through a NOT gate NT4 to the other input terminal of the gate AD7. An output signal of the gate AD7 is supplied through a NOT gate NT5 to one input terminal of a two-input OR (disjunction) gate OR1. An output signal of the gate AD6 is supplied to the other input terminal of the gate OR1 and an output signal of the gate OR1 the other input terminal of the gate AD3.

Output signals of the gates AD3 and AD5 are input to input terminals of a two-input OR gate OR2 placed at the stage following AD3 and AD5, and an output signal of the gate OR2 is input to a clock signal input terminal (CLK) of the D flip-flop D-FF.

The D flip-flop D-FF has a D input terminal connected to a Q bar output terminal (in the figure, Q is overscored with a bar), whereby the configuration of a T-type flip-flop is provided. The Q output signal is sent to the drive circuit DRV1 as Sdrv1 and the Q bar output signal is sent to the drive circuit DRV2 as Sdrv2.

In the polarity switch control circuit, to send a pulse on the rising edge or the falling edge of the signal CK, provided by the gates AD1 and NR1 to the clock signal input terminal CLK of the D flip-flop D-FF through the gates AD3, AD5, and OR2 at the stages following the gates AD1 and NR1, the output signals of the gates NT3 and OR1 need to be high.

Now assume that if the discharge lamp 61 is lighted (the signal S1 is high) and the discharge lamp 62 is out (the signal S2 is low), the signal LT2 corresponding to the discharge lamp 62 goes high (namely, a lighting instruction of the discharge lamp 62 is issued).

In this case, since the signal S1 is high, the output signal of the gate AD6 is low and thus a high signal provided by the gate NT3 (negation) is sent to the gate AD5.

The signal S2 is low and the negation signal of the signal S2 provided by the gate NT4 and LT2 (high signal) are input to the gate AD7, then an output signal of AD7 (high) is input to the gate NT5, which then outputs a low signal to the gate OR1. At the time, the signal sent from the gate AD6 to OR1 is low and thus an output signal of the gate OR1 becomes a low signal.

A pulse generated in synchronization with the falling edge of the signal CK is input to the gate AD4. If the Q output signal of the D flip-flop is high, the pulse is sent to the gate AD5. Since a high signal from NT3 is input to the gate AD5, the pulse passes through the gate AD5 and OR2 at the following stage and is sent to the terminal CLK of the D flip-flop. Consequently, the state of the D flip-flop is inverted and the Q output signal goes low. If the Q output signal of the D flip-flop input to the gate AD4 is low, the output signal of the AD4 gate goes low, thus the state of the D flip-flop remains unchanged and the Q output signal remains low. Therefore, the signal Sdrv1 is fixed to a low state.

Then, if the discharge lamp 62 is lighted, the signal S2 goes high, thus the output signal of the gate AD7 goes low because of the negation signal from NT4. Therefore, a high signal provided by the gate NT5 (negation) passes through the gate OR1 and is sent to the gate AD3. Thus, a pulse generated in synchronization with the rising edge of the signal CK is input from the gate AD1 through AD2, AD3, and OR2 to the terminal CK of the D flip-flop, so that the state of the D flip-flop is inverted continuously and square wave signals each having a predetermined basic frequency (for example, 500 Hz) are provided as the signals Sdrv1 and Sdrv2.

It can be easily made certain that if the discharge lamp 62 is lighted and the discharge lamp 61 is out, when a light instruction of the discharge lamp 61 is issued, the signal Sdrv1 is fixed high until the discharge lamp 61 is lighted. The reason is that since the high signal from OR1 is input to the gate AD3 and the low level from NT3 is input to the gate AD5, if the Q bar output signal of the D flip-flop is high, the high signal output by the gate AD1 causes the state of the D flip-flop to be inverted, defining the Q output signal high.

The operation is briefly summarized as follows:

(a) When LT1 is high and Si is low, Sdrv1 goes high and Sdrv2 goes low;

(b) when LT2 is high and S2 is low, if LT1 is low or S1 is high, Sdrv1 goes low and Sdrv2 goes high;

(c) otherwise, square wave signals are provide as Sdrv1 and Sdrv2 (note that the output signals of the gates NT3 and OR1 cannot go low together).

In the configuration wherein when the signal Sdrv1 is high, the switch elements sw1 and sw2 are defined to be on and off respectively and the signal Sdrv2 is low, the switch elements sw3 and sw4 are defined to be off and on respectively, the supply voltage to the discharge lamp 61 is defined as positive-polarity voltage and the supply voltage to the discharge lamp 62 is defined as negative-polarity voltage in (a) above, and the supply voltage to the discharge lamp 61 is defined as negative-polarity voltage and the supply voltage to the discharge lamp 62 is defined as positive-polarity voltage in (b) above.

In (a) and (b), the signal related to the discharge 61 and the signal related to the discharge 62 are not symmetrical, because a function of lighting the discharge lamp 61 preferentially is adopted. That is, if both the discharge lamps are out (S1 is low and S2 is low) and light instruction signals of the discharge lamps are output (LT1 is high and LT2 is high), first Sdrv1 goes high and the polarity of supply voltage to the discharge lamp 61 is fixed to positive polarity according to (a) above and then when the discharge lamp 61 is lighted (S1 is high), Sdrv2 goes high and the polarity of supply voltage to the discharge lamp 62 is fixed to positive polarity according to (b) above. Thus, after the polarity of the supply voltage is fixed before the discharge lamp is lighted, the output voltage of the DC power supply circuit (in this case Vdcp) is raised to a necessary sufficient level by the control circuit and then a start pulse is applied to the discharge lamp, whereby the discharge lamp can be lighted reliably.

It is desirable to control as follows: The state of each switch element is fixed so that to light either of the two discharge lamps, before the discharge lamp is lighted, the polarity of the voltage supplied from the DC-AC conversion circuit to the discharge lamp is defined as either the positive or negative polarity (in the example, the polarity of the voltage supplied o the discharge lamp to be lighted is defined as the positive polarity. Of course, to define the polarity as the negative polarity, the definition relationship between the signals Sdrv1 and Sdrv2 and the on/off state of each switch element may be inverted), and the alternating operation of each switch element is performed after the discharge lamp is lighted. For example, if such polarity definition is not made before the discharge lamp is lighted, each of the DC-DC converters 3A and 3B requires a current auxiliary circuit. The reason is that since the polarity is not defined, if only one converter is provided with a current auxiliary circuit, the capacitor in the circuit cannot sufficiently be charged or the voltage increasing capability of the converter must be enhanced. However, according to the invention, the current auxiliary circuit may be provided only at the stage following either the DC-DC converter 3A or 3B, so that the configuration is simplified.

That is, the current auxiliary circuit may be added only to one output terminal to1 (or to2) of the DC power supply circuit 3 corresponding to the polarity of the voltage supplied from the DC-AC conversion circuit 4 to one discharge lamp before this discharge lamp is started. For example, as described above, to define the polarity of the supply voltage to the discharge lamp as positive polarity, the current auxiliary circuit 9 (see FIG. 4) is added only to the stage following the DC-DC converter 3A outputting the voltage Vdcp. At the time, it becomes unnecessary to raise the output voltage of the DC-DC converter 3B to the voltage required in the DC-DC converter 3A before the discharge lamp is lighted. In other words, the withstand voltage of the switch elements on the side supplying negative-polarity voltage to the discharge lamp (switch elements sw2 and sw4 on the low-stage side), of the two pairs of the switch elements forming the above-mentioned full-bridge type circuit can be lowered. That is, for the withstand voltage of the switch element, the following range is preferred:

Not less than a voltage applied at the last stage of the life of the discharge lamp, (Due to degrade of the lamp characteristics, higher voltage is necessitated to apply the discharge lamp);

if the polarity of the supply voltage to the discharge lamp before the discharge lamp is lighted is temporarily fixed to the positive polarity, when the voltage temporarily supplied to the discharge lamp by the DC-DC converter 3A is Vovc, smaller than Vovc (preferably, less than a half Vovc).

Thus, for the output terminal of the DC power supply circuit outputting voltage of an opposite polarity to the polarity of the voltage supplied from the DC-AC conversion circuit to the discharge lamp before this discharge lamp is started (the output terminal to2 of vdcn if the polarity is defined as the positive polarity or the output terminal to1 of Vdcp if the polarity is defined as the negative polarity), the output voltage provided from the output terminal is defined so as to always become lower than the output voltage provided from the other output terminal of the DC power supply circuit, or is limited (specifically, an upper limit is imposed on the duty cycle of the control signal Sc to the switch element SW in FIG. 2), whereby the withstand voltage design of circuit elements can be provided with a margin.

To reduce the number of parts and costs, preferably the above-mentioned starter circuits 51 and 52, which are provided as separate circuits, are made a common circuit between the two discharge lamps 61 and 62.

Figure 8:
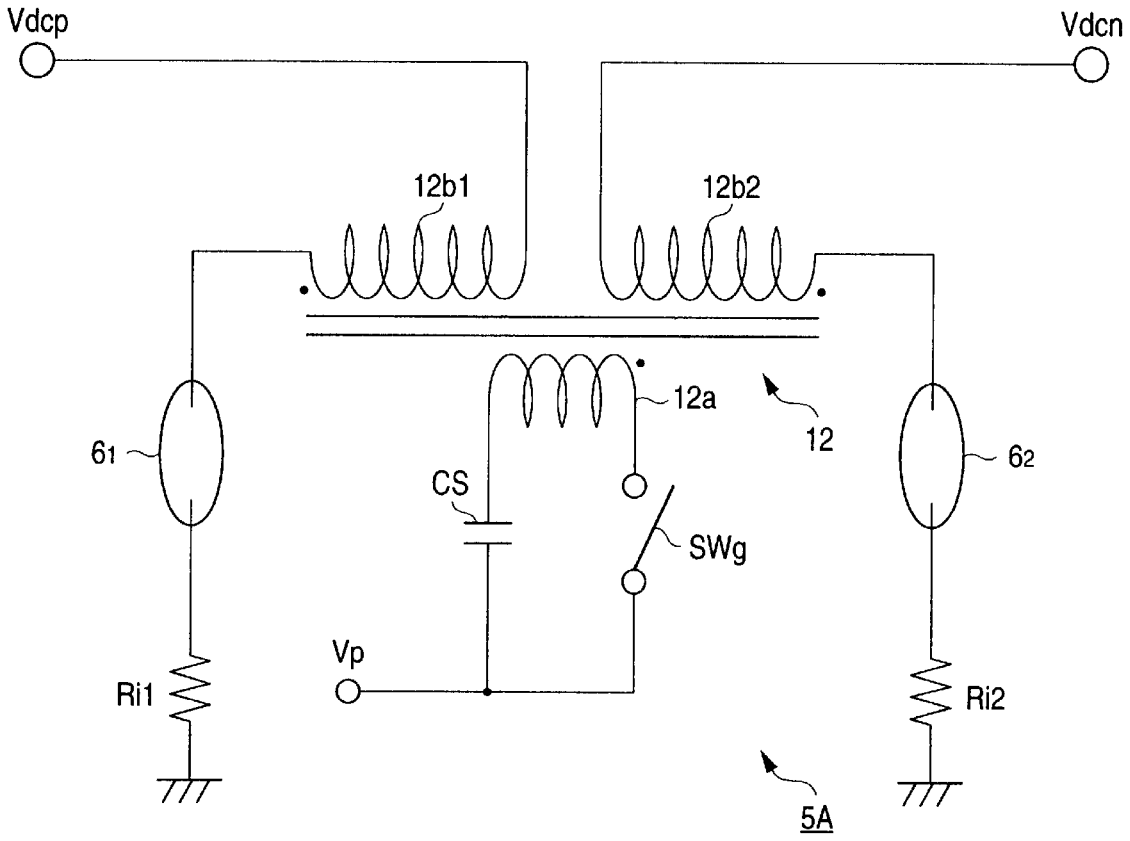
FIG. 8 is a circuit diagram to show a configuration example of a starter circuit made common between two discharge lamps.

FIG. 8 shows such a starter circuit configuration example 5A.

A transformer 12 in the starter circuit 5A comprises two secondary windings 12*b*1 and 12*b*2 relative to one primary winding 12*a*, and the secondary windings 12*b*1 and 12*b*2 are connected to the discharge lamps 61 and 62 respectively.

The primary circuit of the transformer 12 containing the primary winding 12*a* is provided with a capacitor CS and a switch element SWg. After the capacitor CS is charged by primary voltage Vp, it is discharged as the switch element SWg conducts (or breaks down). The generated voltage at this time is increased by the transformer 12, then applied to the discharge lamps 61 and 62 via the secondary windings 12*b*1 and 12*b*2.

For example, the following supply methods of the primary voltage Vp are available, any of which may be used:

(I) Method of providing the primary voltage from output voltage of the DC power supply circuit or the DC-AC conversion circuit;

(II) method of providing the primary voltage by increasing output voltage of the DC power supply circuit or the DC-AC conversion circuit through a voltage doubler circuit, etc.;

(III) method of providing the primary voltage by adding a winding to the secondary side of a converter transformer placed in the DC power supply circuit and rectifying and smoothing output of the secondary winding.

Preferably, the winding beginnings (or winding terminations) of the secondary windings 12*b*1 and 12*b*2 of the transformer 12 are defined as the connection terminal sides to the discharge lamps, whereby the connection relationship is unified (in the figure, the winding beginning is indicated by the "·"). Although the reason is omitted, the polarities of the start signals to the discharge lamps are unified, whereby the withstand voltage design of the transformer is made advantageous and the supply directions of primary energy are unified, whereby the effect of the electromagnetic coupling between the secondary windings when striking potential again occurs is decreased and the discharge lamp is prevented from easily going out at the polarity switching time afte[00f8] the discharge lamp is lighted.

To light both the discharge lamps 61 and 62 at the same time from the state in which the discharge lamps are out, similar start (pulse) signals are applied to the discharge lamps, so that the discharge lamps can be started at the same time (or almost the same time). If one discharge lamp 61 is lighted without a problem and lighting the other discharge lamp 62 ends in failure, again the start signal is generated for starting the latter discharge lamp 62, whereby the discharge lamp can be lighted. At the time, the start signal is also applied to the lighted discharge lamp 61. However, since the impedance of the discharge lamp at the lighting time is low, the generated voltage is attenuated immediately and thus has no effect. On the other hand, the voltage generated on the secondary winding 12*b*2 connected to the discharge lamp 62 not lighted is a high-frequency voltage, so that the * planned start signal is applied to the discharge lamp 62 with little receiving the effect of voltage attenuation on the secondary winding 12*b*1 connected to the discharge lamp 61.

Figure 9:
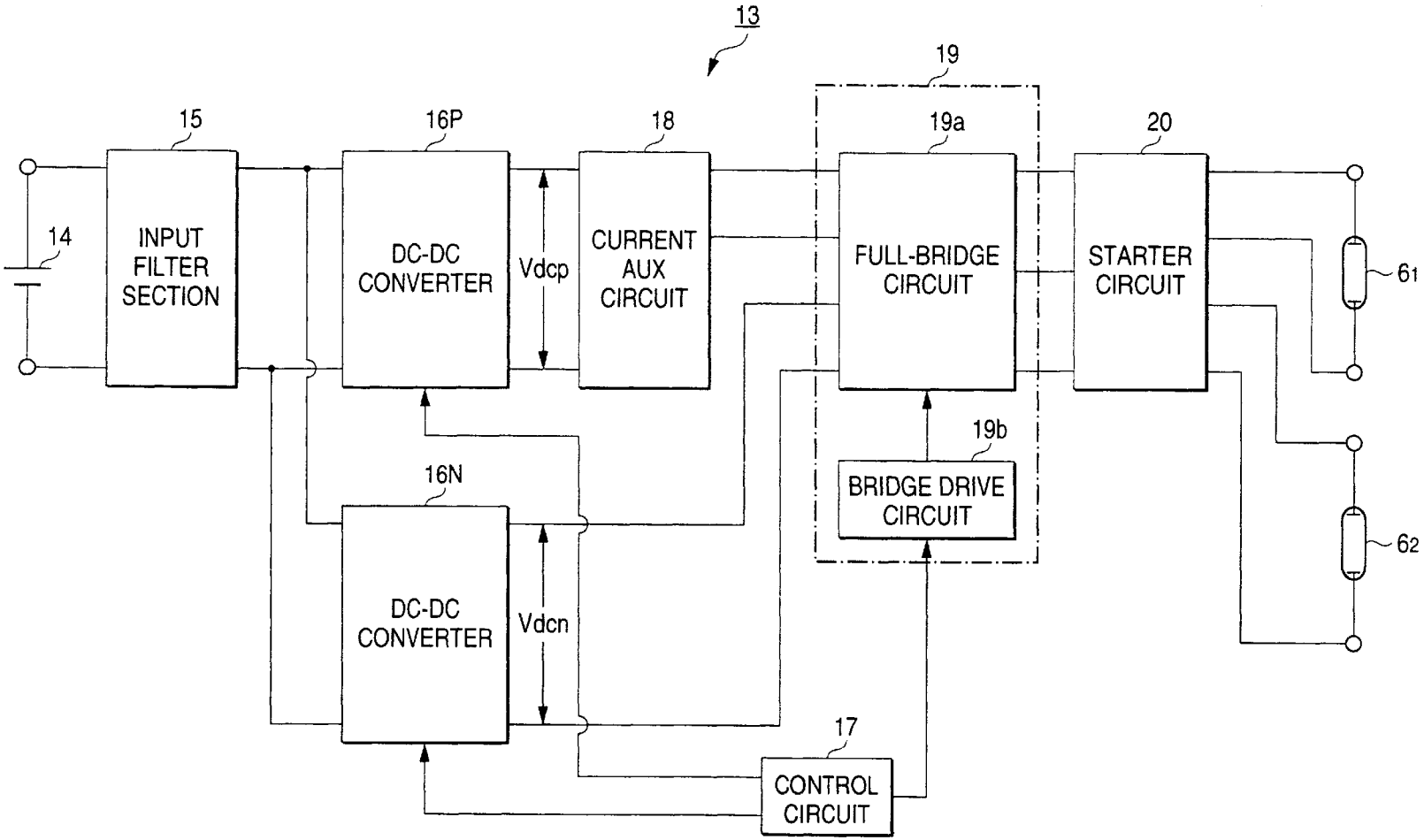
FIG. 9 is a circuit block diagram to show one embodiment of the invention.

FIG. 9 shows one embodiment of the invention; it shows an application example to car's front lights (circuit configuration example to use two discharge lamps).

In a lighting circuit 13, terminal voltage of a battery 14 is supplied through an input filter section 15 to a DC-DC converter 16P for positive-polarity voltage output and a DC-DC converter 16N for negative-polarity voltage output.

A control circuit 17 is provided for the DC-DC converters to control output voltages thereof, and control signals issued by the control circuit 17 are sent to the DC-DC converters. That is, in this case, switch elements connected to two primary windings in a transformer receive the control signals and are turned on/off under the control, whereby the output voltage of each DC-DC converter is controlled.

The control circuit 17 is provided for controlling power supply to the discharge lamps based on detection signals of tube voltage and tube current of each discharge lamp or their equivalent signals, such as detection signals from a detection circuit placed at the stage following the DC-DC converter 16P. For example, a circuit using an operational amplifier, etc., for generating a signal for supplying excessive power exceeding the related power at the initial stage of the discharge lamp according to a control curve in a tube voltage-tube current characteristic chart of the discharge lamp, then gradually decreasing the supplied power and making the transition to constant-power control with the related power can be named. (See JP-A-4-141988.) The DC-DC converter 16P is followed by a current auxiliary circuit 18. That is, in the embodiment, the polarity of voltage supplied to the discharge lamp before the discharge lamp is lighted is temporarily fixed to the positive polarity.

Figure 4:
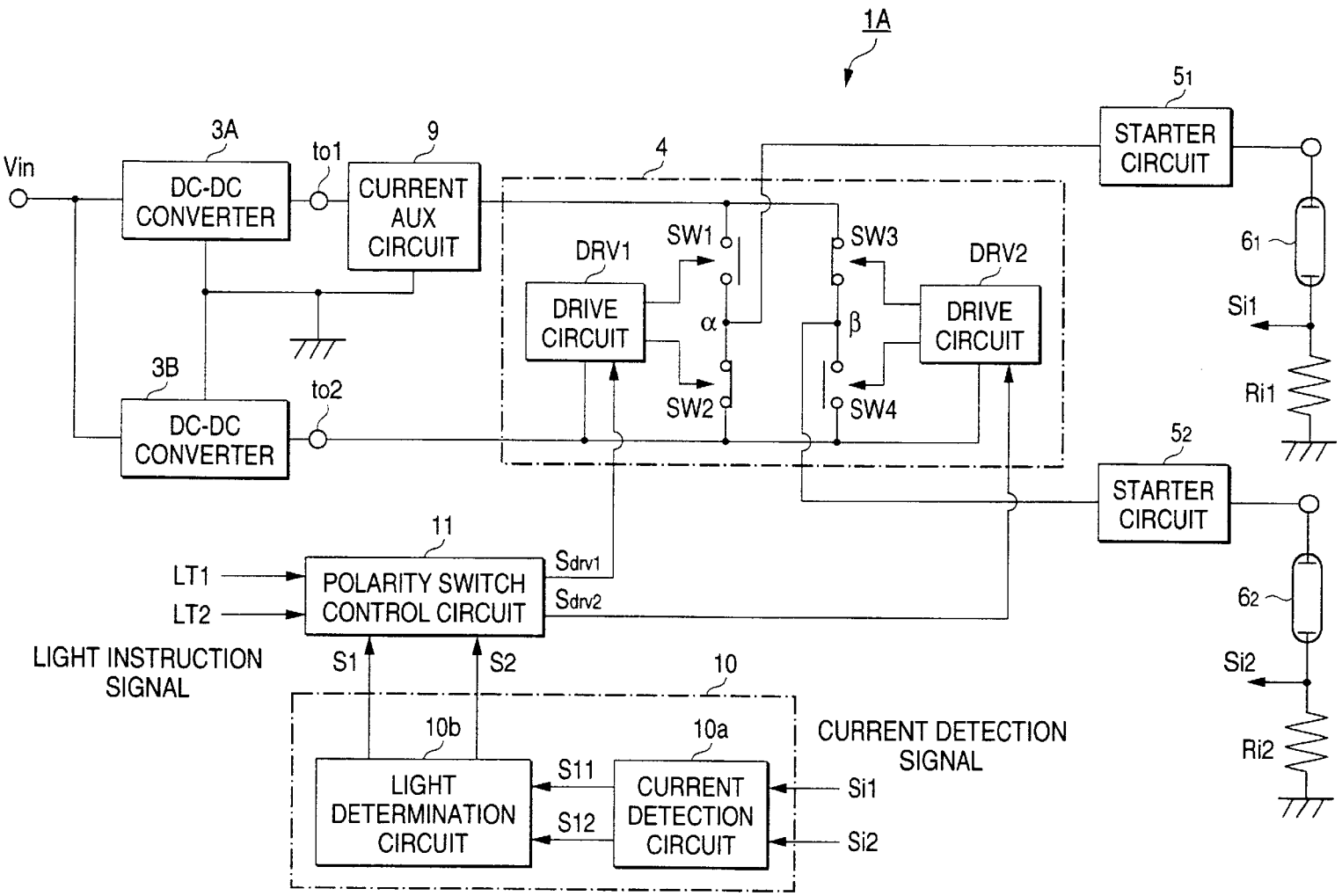
FIG. 4 is a drawing to show a configuration example for lighting two discharge lamps.

A DC-AC converter 19 consists of a full-bridge type circuit 19*a* (see FIG. 7 for the internal configuration of the circuit 19*a*) and a bridge drive circuit 19*b* made up of two half-bridge drivers, and corresponds to the DC-AC conversion circuit 4 in FIG. 4. That is, four semiconductor switch elements provided in the full-bridge type circuit 19*a* a are grouped into two pairs and switching control is performed reciprocally, whereby DC input voltage is converted into square wave voltage. For this purpose, the bridge drive circuit 19*b* generates control signals to the switch elements; it operates upon reception of a signal sent from the control circuit 17.

A starter circuit 20 is provided in common to the two discharge lamps 61 and 62 at the stage following the DC-AC converter 19. The discharge lamps 61 and 62 may be used as light sources of front lights placed on the left and right of the front of a vehicle respectively or may be used as light sources of a high beam and a low beam respectively (in this case, control is required so as not to light the unused discharge lamp in response to beam change).

The configuration of the starter circuit 20 is as shown in FIG. 8 and therefore will not be discussed again in detail. In the embodiment, a spark gap element is used as a switching element. This means that the voltage generated by the discharge current of a capacitor when the element breaks down is applied to the discharge lamp through a secondary winding.

To light only one discharge lamp 61 from the state in which both the discharge lamps 61 and 62 are out, the on/off state of each switch element in the full-bridge type circuit 19*a* is defined so as to supply positive-polarity voltage to the discharge lamp 61 and supply voltage Vdcp to the discharge lamp 61 in the period is raised to the level required for the DC-DC converter 16P (Vovc), then a start signal is generated for starting the discharge lamp 61. To light only the other discharge lamp 62, the on/off state of each switch element in the full-bridge type circuit 19*a* is defined so as to supply positive-polarity voltage to the discharge lamp 62 and supply voltage Vdcp to the discharge lamp 62 in the period is raised to the level required for the DC-DC converter 16P (Vovc), then a start signal is generated for starting the discharge lamp 62. Such a control sequence is adopted, whereby the current auxiliary circuit 18 needs to be provided only at the stage following the DC-DC converter 16P, so that the circuit configuration is simplified.

As seen from the description made above, according to the invention as claimed in claim 1, for a plurality of discharge lamps, two pairs of switch elements are provided in the DC-AC conversion circuit and it is made possible to control lighting each discharge lamp by performing the alternating operation of the full-bridge type circuit consisting of the switch elements, so that the circuit configuration is simplified, the number of parts and the costs can be reduced, the circuit can be miniaturized, and the required space can be saved. The polarity of the voltage supplied to the discharge lamp before the discharge lamp is lighted is fixed to either polarity, whereby the discharge lamp can be well lighted.

According to the invention as claimed in claim 2, in the lighting circuit for lighting two discharge lamps, the DC power supply circuit is shared and the DC-AC conversion circuit of the full-bridge type configuration using four switch elements is adopted, whereby the circuit configuration is simplified (the numbers of the switch elements and their drive circuits are halved as compared with the configuration in the related art).

According to the invention as claimed in claim 3, the current auxiliary circuit needs to be provided only for one of the two output terminals of the DC power supply circuit, so that the number of current auxiliary circuits can be reduced by one as compared with the circuit in the related art.

According to the invention as claimed in claim 4, the output voltage provided from one of the two output terminals of the DC power supply circuit is always limited to lower voltage than the output voltage provided from the other output terminal of the DC power supply circuit, whereby the withstand voltage of the switch elements forming the DC-AC conversion circuit can be lowered.

What is claimed is:

1. A discharge lamp lighting circuit comprising:

a DC power supply circuit for generating a desired DC voltage from a DC input voltage, having two output terminals from which positive-polarity voltage and negative-polarity voltage are respectively output;

a DC-AC conversion circuit for converting the output voltage of said DC power supply circuit into AC voltage and then supplying the AC voltage to a plurality of discharge lamps, said DC-AC conversion circuit having a first and a second pairs of switch elements for switching the positive output voltage and the negative output voltage sent from said DC power supply, each of first and second pair of the switch elemens which are connected in series between the output terminals of said DC power supply circuit; and a drive circuit for alternatively driving said first pair and second pair of the switch elements, wherein, to light one of the discharge lamps, the state of each of the switch elements is fixed so that the polarity of the voltage supplied from said DC-AC conversion circuit to the discharge lamp before the discharge lamp is started is defined as either positive or negative polarity and the switch elements are alternately operated after the discharge lamp is lighted.

2. The discharge lamp lighting circuit as claimed in claim 1, further comprising: a detection circuit for detecting at least one of voltage and current relating to each discharge lamp, and a control circuit for controlling voltage, current or supply power of each discharge lamp in response to a detection signal from said detection circuit.

3. The discharge lamp lighting circuit as claimed in claim 1, wherein said DC power supply circuit has a positive circuit section for outputting positive-polarity voltage and a negative circuit section for outputting negative-polarity voltage.

4. The discharge lamp lighting circuit as claimed in claim 1, wherein first discharge lamp is connected to a connection point of the first pair of the switch elements, and second discharge lamp is connected to a connection point of the second pair of the switch elements; and another electrode of each of first and second discharge lamps is connected to ground.

5. The discharge lamp lighting circuit as claimed in claim 4, wherein while positive-polarity voltage is supplied to the first discharge, negative-polarity voltage is supplied to the second discharge lamp and conversely, and while negative-polarity voltage is supplied to the first discharge lamp, positive-polarity voltage is supplied to the second discharge lamp.

6. The discharge lamp lighting circuit as claimed in claim 4, wherein said another electrode terminal of the discharge lamp is directly connected to ground.

7. The discharge lamp lighting circuit as claimed in claim 4, wherein said another electrode terminal of the discharge lamp is connected to ground through current detection means.

8. The discharge lamp lighting circuit as claimed in claim 1, further comprising a current auxiliary circuit for supplying energy accumulated in a capacitive load when the discharge lamp is started to aid a transition from glow discharge to arc discharge, the current auxiliary circuit being placed between said DC power supply circuit and said DC-AC conversion circuit, wherein said current auxiliary circuit is provided only for one output terminal of said DC power supply circuit corresponding to the polarity of voltage supplied from said DC-AC conversion circuit to the discharge lamp before the discharge lamp is started.

9. The discharge lamp lighting circuit as claimed in claim 8, wherein for the output terminal of said DC power supply circuit for outputting voltage of an opposite polarity to the polarity of the voltage supplied from said DC-AC conversion circuit to the discharge lamp before this discharge lamp is started, the output voltage from the output terminal is defined so as to always become lower than the output voltage from the other output terminal of said DC power supply circuit.

10. The discharge lamp lighting circuit as claimed in claim 4, wherein one of said first and second discharge lamps is used as light source of a high beam and the other is used as light source of a low beam.

11. The discharge lamp lighting circuit as claimed in claim 4, wherein one of said first and second discharge lamps is used as light source of front lights placed on the left side of the front of a vehicle and the other is used as light source of the right side.

* * * * *